US007458502B2

(12) United States Patent
Habeger, Jr. et al.

(10) Patent No.: US 7,458,502 B2
(45) **Date of Patent: *Dec. 2, 2008**

(54) CONTAINER

(75) Inventors: Charles C Habeger, Jr., Burien, WA (US); Randall T Telling, Puyallup, WA (US)

(73) Assignee: International Paper Company, Loveland, OH (US)

( * ) Notice: Subject to any disclaimer, the term of this patent is extended or adjusted under 35 U.S.C. 154(b) by 132 days.

This patent is subject to a terminal disclaimer.

(21) Appl. No.: 11/395,411

(22) Filed: Mar. 31, 2006

(65) Prior Publication Data

US 2007/0228126 A1 Oct. 4, 2007

(51) Int. Cl.
*B65D 5/12* (2006.01)

(52) U.S. Cl. ..... 229/122.3; 229/122.33; 229/125.19; 229/939

(58) Field of Classification Search ..... 229/125.19, 229/122.27, 122.3, 122.33, 939
See application file for complete search history.

(56) References Cited

U.S. PATENT DOCUMENTS 1,430,149 A * 9/1922 Bliss ..... 229/125.19
2,704,179 A * 3/1955 Wilcox ..... 229/125.19
2,766,923 A * 10/1956 D Esposito ..... 229/125.19
3,291,364 A * 12/1966 Fischer ..... 229/122.3
4,017,016 A * 4/1977 Ivy ..... 229/122.33
4,830,271 A * 5/1989 Lau et al. ..... 229/125.33
5,215,248 A * 6/1993 Moser ..... 229/122.27
5,758,818 A * 6/1998 Ewing, Jr. ..... 229/122.3
5,938,108 A * 8/1999 Williams et al. ..... 229/122.3

OTHER PUBLICATIONS

The Wiley Encyclopedia of Packaging Technology, John Wiley & Sons, pp. 66-68, 500-506 (1986).*

Weyerhaeuser Company "Double Cover Box," *Handbook of Corrugated and Solid Fibreboard Boxes and Products*, Weyerhaeuser Co. Shipping Division, p. 34, 1965.

* cited by examiner

*Primary Examiner*—Gary E Elkins

(57) ABSTRACT

A container has side walls of substantially equal height and top and bottom lids. Each lid has a central panel and side panels attached to the central panel by score lines. The lids have an annular crushed area in the central panel which is conterminous with the score lines. The container side walls fit into the annular crushed area. The bottom lid side panels are fastened to the container side walls.

6 Claims, 6 Drawing Sheets

CONTAINER

This is directed to a shipping container and the blanks for the container.

One type of container used as a shipping container is a regular slotted container known as an RSC. It is the blank 10 shown in FIG. 1 and the container 11 shown in FIG. 2. It has side walls 12 and 13 and end walls 14 and 15 attached to each other by score lines. An attachment panel 16 is attached to side wall 12 by a score line. The attachment panel 16 is glued to end panel 15 in the finished container. Closure flaps 17, 18, 19 and 20 are attached by score lines on the upper and lower edges of the side walls 12 and 13, and closure flaps 21, 22, 23 and 24 are attached to the upper and lower edges of end walls 14 and 15.

In forming the container for use, the container is opened from a lay-flat position and the lower closure flaps 19, 20, 23 and 24 are folded in and fastened together. The container is filled and the upper closure flaps 17, 18, 21 and 22 are folded in and fastened together. The top and bottom end panel closure flaps are usually covered by the side panel closure flaps.

Another type of container used as a shipping container is a bliss box. The blanks for one type of bliss box are shown in FIGS. 3 and 4 and the bliss box shown in FIG. 5. FIG. 3 shows the body blank 30 which has a side wall 31, bottom wall 32 and side wall 33 connected by score lines. Flaps 34, 35 and 36 are attached to each side of walls 31, 32 and 33, respectively, by score lines. There may be hand holes 37 in the side walls 31 and 33. The hand holes 37 are optional.

FIG. 4 shows the blank for the end walls 35. The bliss box is formed by attaching the end walls 35 to the body 30 by the flaps 34, 35 and 36.

The bliss box may have a telescoping cover. The blank 40 for the cover is shown in FIG. 6. The blank 40 has attachment panel 41 and side wall 42, end wall 43, side wall 44 and end wall 45 separated by score lines. There may be hand holes 46 in side walls 42 and 44 which match the hand holes 37 when the cover is placed over the container. Cover panels 47, 48, 49 and 50 are attached to the side walls 42, 43, 44 and 45 by score lines. In forming the cover the attachment panel 41 is attached to the outer edge of wall 45. The cover panels 48 and 50 are bent downwardly and the cover panels 47 and 49 are bent downwardly over them. The cover panels are attached to each other.

The cover is telescoped over the container in the packed bliss box.

FIG. 7 shows another type of end wall 35'. This end wall has flaps 38 and 39 attached to each side of the end wall 35' by score lines. In the formed container the flaps 38 and 39 may be attached to the inner side of side walls 31 and 33.

Another type of container is the double cover container. The blanks for this container are shown in FIGS. 8 and 9 and the container is shown in FIG. 10. The blank 80 for the body has side walls 81, 82, 83 and 84 and attachment panel 85 connected by score lines. The attachment panel 85 is attached to the outer edge of side wall 81. The attachment panel is optional. The walls may be joined by a tape 94 holding side wall 81 to side wall 84. The blank 86 for the upper and lower lids has a central panel 87 and two pair of opposed side panels 88 and 89 attached to the four sides of the central panel 87 by score lines. Tabs 90 are attached to the side edges of two opposed side panels 88 by score lines. When the lids 92 are formed the tabs 70 are bent inwardly and attached to the opposed side panels 89. The lids 92 are telescoped over the body 93 and usually strapped in place.

For storage and transport the containers are stacked several high so stacking strength is necessary. A container should hold the containers above it without transferring the load to the contained product and its deformation should be minimal.

A corrugated container has a wall made of central flutes made of corrugating medium held in place by outer liners glued to the flutes. The flutes will normally extend vertically in the filled container to provide stacking strength. The actual stacking strength will depend on the size of the flute and the weight of the corrugating medium and the weight of the liners.

There are several size flutes. Some flute sizes are A flute which has 36 flutes per lineal flute and is 3/16 inch from flute tip to flute tip; B flute which has 51 flutes per lineal flute and is 3/32 inch from flute tip to flute tip; C flute which has 39 to 42 flutes per lineal flute and is 9/64 inch from flute tip to flute tip; and E flute which has 96 flutes per lineal flute and is 3/64 inch from flute tip to flute tip.

Basis weights for corrugating medium are from 16 to 40 pounds per thousand square feet. Basis weights for liner are from 20 to 96 per thousand square feet.

It should be understood that the higher basis weights increase the cost of a container.

The stacking strength may also be increased by using multiwall board. The board may be double wall with an external liner, a corrugated medium, a central liner, another corrugated medium and another outer liner. The board may be triple wall with an outer liner, a corrugating medium, an inner liner, a second corrugating medium, another inner liner, another corrugating medium and another external liner. The medium may be any flute size and the weights of the various elements may be the same or different. Again, the addition of the additional material increases the cost of the container.

After much research, and many trials it has been discovered that there is a simple way of increasing the stacking strength of a container without increasing the basis weight of the various elements of the container, or increasing the number of walls of the container.

In the present invention, the lids may be formed of single wall corrugated having liners attached to both side of the corrugated flutes, double wall corrugated or triple wall corrugated. The flutes may be of any size of which A, B, C or E are exemplary. The weight of the liners and flutes may be any weight which is appropriate for the container. The side walls of the container body may also be single, double or triple wall corrugated, have flutes of any appropriate size and have liners and flutes of any appropriate weight for the goods within the container.

Figure 11:
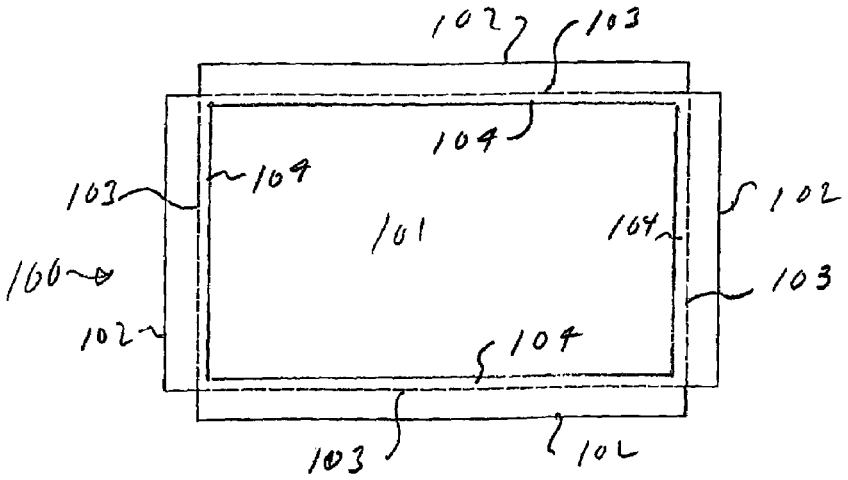
FIG. 11-12 are top plan views of blanks for an embodiment of the present invention.
Figure 12:
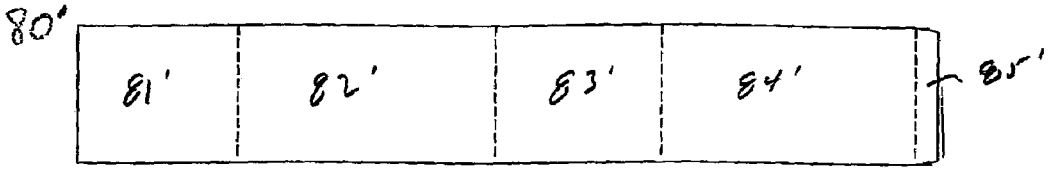
Figure 13:
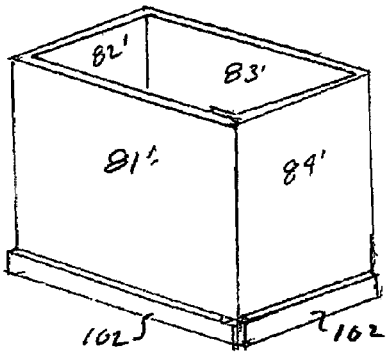
FIG. 13 is an isometric view of a container made from the blanks of FIGS. 11-12.

FIG. 11 shows a blank for an embodiment of the present invention. It is the bottom lid of a double cover container. It may also be used as the top lid of the container.

The blank 100 has a central panel 101 and four side panels 102 attached to the four sides of the central panel 101 by score lines 103. There are no tabs attached to the side panels 102. The central panel 101 also has an annular depression or crushed area 104 which is inside of and conterminous with the score lines 103. The depression is formed by crushing the corrugated so that the corrugating medium and liners are crushed flat. The width of the crushed area will be at least the same width as the thickness of the side walls 81'-84' of the body of the container. It will be wide enough to also accommodate the attachment panel if an attachment panel is used to attach the side walls together. It may be one quarter to one-half inch in width, depending on the type of side wall that is being used.

Figure 14:
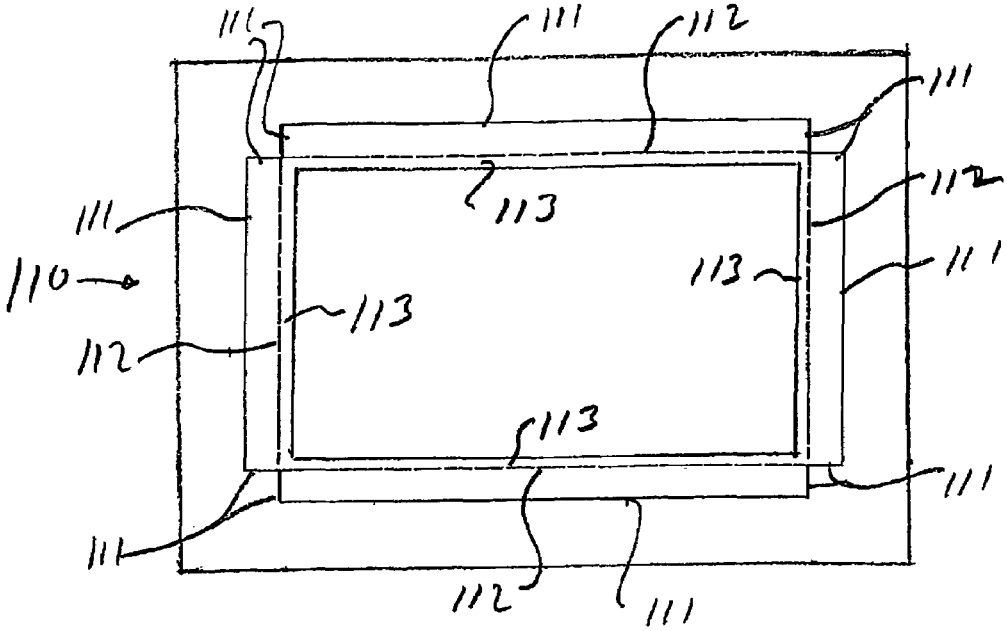
FIG. 14 is a top plan view of die for forming the blank of FIG. 11.

The blank 100 can be formed using the die 110 of FIG. 14. The die 110 is shown as a flat press die but it can also be a rotary die. The die 110 has cutting dies 111 to cut out the outline of the blank 100 and scoring rules 112 to score the blank. The die also has annular crushing members 113 conterminous with the scoring rules to crush the blank 100 adjacent the score lines. The depth of the scoring rules 112 and crushing members 113 with respect to the cutting dies 111 will allow the scores to be formed in the normal way and the crushed section forming the annular depression to have the various layers of the corrugated blank to be crushed flat. In use the die will cut out the blank from the corrugated, score the blank and crush the blank in one operation.

Figure 6:
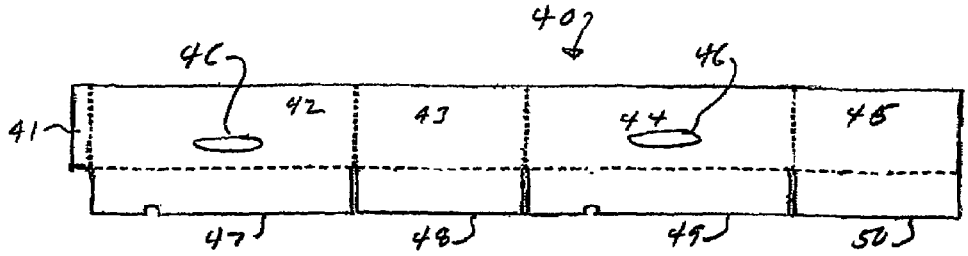
FIGURE 6 (PRIOR ART)
FIG. 6 is a top plan view of a telescoping cover for the bliss box.

The blank 105 for the body is the same as the blank 80 of FIG. 6 and like reference numerals have been used.

In one embodiment, the body usually is formed into a lay flat condition at the corrugated plant by gluing the attachment panel 85' to the outer edge of the inner side of side panel 81'. In another embodiment the outer edges of panels 81' and 84' may be taped together if there is no attachment panel 85'.

At the point of use the container can be formed by hand or by machine.

In the method of forming the container, the side walls 81', 82', 83' and 84' will be squared so that two opposing sides are substantially parallel. The walls will form a rectangular tube. The lid 100 will be aligned with the body. In the alignment the crushed area 104 will be aligned with the edges of the side walls of the container body. This will be done by moving the lid relative to the body. The lid may be moved to align it with the body or the body may be moved to align it with the lid. The body and lid are then moved relatively toward each other to seat the body side wall edges into the crushed annular area 104.

Glue will be placed on the panels 102. The glue may be placed on the panels 102 while the lid is being moved into position for the alignment step, during the alignment step, the seating step or after the body and lid have been aligned and seated. In an embodiment the glue may be placed on the side walls 81', 82', 83' and 84' in the location of the joinder of the lid panels and side walls instead of the panels 102. The glue may be placed on the side walls while the side walls are being moved into position for the alignment step, during the alignment step, the seating step or after the body and lid have been aligned and seated.

The panels 102 will then be folded up around the body side walls and adhered to the body side walls. This will be done by either moving the body and lid in the direction of the lid and folding up the flaps during the movement, or by keeping the body and lid stationary and folding up the panels 102.

In one embodiment the side walls 81', 82', 83' and 84' will be squared so that two opposing sides are substantially parallel. The side walls will form a rectangular tube. The tube will be horizontal. The lid 100 will be moved vertically into alignment with the body. Glue will be placed on the lid side panels by during that movement of the lid into alignment with the side walls. A mandrel will be inserted into the container body formed by the side walls and move the body toward the lid until the side wall edges are seated in the annular crushed area. The mandrel will carry the body and lid will through a die cavity which will bend the lid panels around their score lines and place the lid panels against the container side walls, holding the lid panels against the side wall long enough to adhere the lid panels to the side walls.

Figure 15:
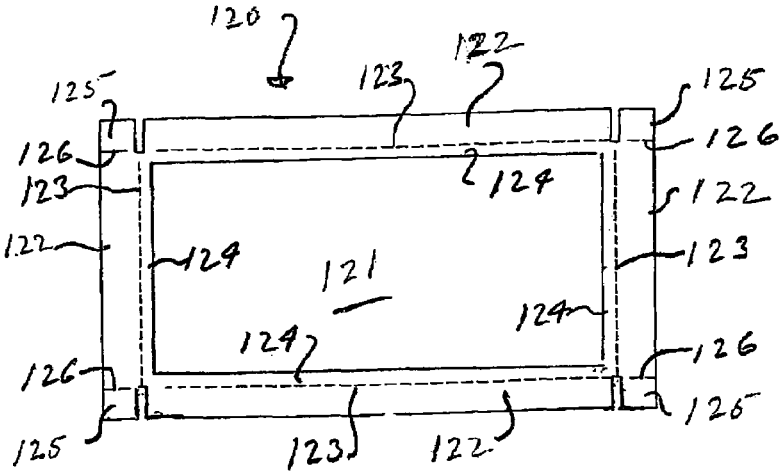
FIG. 15 is a top plan of a blank for a top lid of the present invention

The container will be filled with product and another lid having the design shown in FIG. 11 or in FIG. 15 will be placed on the upper end of the container.

Figure 10:
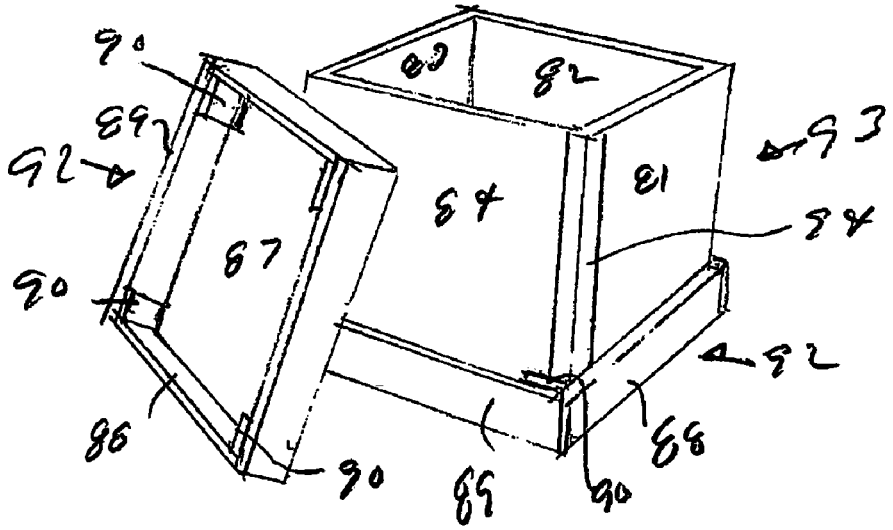
FIGURE 10 (PRIOR ART)
FIG. 10 is a container formed from the blanks of FIGS. 8-9.

The blank 120 shown in FIG. 15 has a central panel 121. Side panels 122 are attached to all sides of the central panel 121 by score lines 123. The central panel 101 also has an annular depression or crushed area 124 which is inside of and conterminous with the score lines 123. The depression is formed by crushing the corrugated so that the corrugating medium and liners are crushed flat. The width of the crushed area will be at least the same width as the thickness of the side walls 81'-84' of the body of the container. It will be wide enough to also accommodate the attachment panel if an attachment panel is used to attach the side walls together. It may be one quarter to one-half inch in width, depending on the type of side wall that is being used. Tabs 125 are attached to the side edges of two opposed side panels 122 by score lines 126. When the lids are formed the tabs 125 are bent inwardly and attached to the opposed side panels 122. The lids have the appearance of lids 92 shown in FIG. 10 with the addition of the annular crushed area.

The top lids are telescoped over the upper ends of the side walls and the side walls will fit into the annular crushed area of the lid. The lid may be loose, or the lid may be attached to the container. If attached, the side panels of the lid can be glued or stapled to the side panels of the container, or the lid can be strapped on the container.

The container and lid are shown as being four sided. The container and lid may have any number of sides. In any configuration the side walls of the container will fit into the crushed area of the upper and lower lids.

Embodiments of the present invention have been tested for stacking strength and for side deformation. In the tests the containers were filled with tennis balls. In the tests the crushed end container used a bottom lid of the design of FIG. 11 and a top unattached lid of FIG. 15. The side walls were seated in the annular crushed areas of both lids and the side walls were glued to the side panels of the bottom lid.

In one test an embodiment was compared to an RSC. Both containers were single wall using a 26 pound C flute corrugated medium, a 42 pound liner attached to the outer side of the flutes and a 35 pound liner attached to the inner side of the flutes. The inner and outer sides refer to the location of the liners in the container. The containers were 20 inches long, fourteen inches wide and 12 inches deep. The maximum compression load for the RSC was 795 pounds. The maximum compression load for the crushed end container was 1250 pounds. The deformation of the side walls at maximum load for the RSC was 0.27 inches. The deformation of the side walls of the crushed end container using a loose upper lid at maximum load was 0.09 inches.

In another test an embodiment was compared to a bliss box having a half slotted container telescoping cover. The containers were 19 inches long, 12 inches wide and 9 inches deep.

Figure 1:
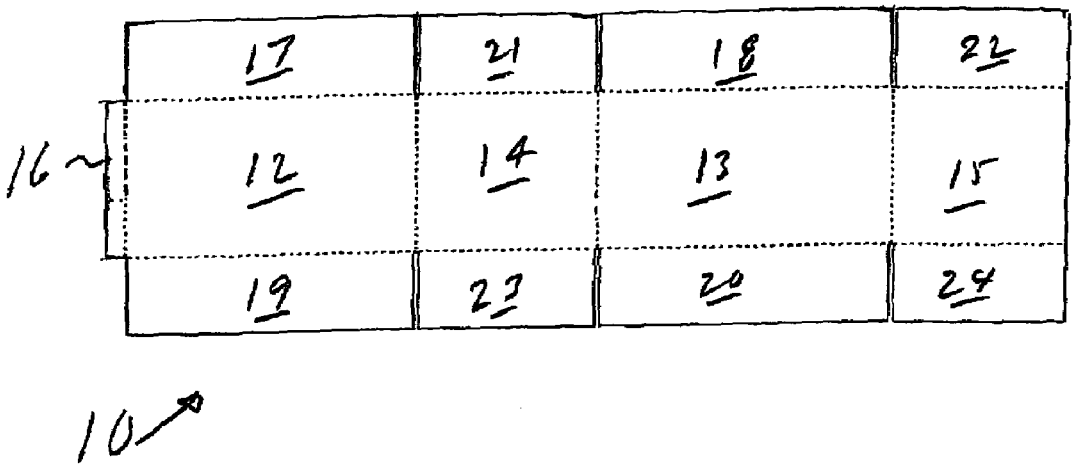
FIGURE 1 (PRIOR ART)
FIG. 1 is a top plan view of a prior art regular slotted container.
Figure 2:
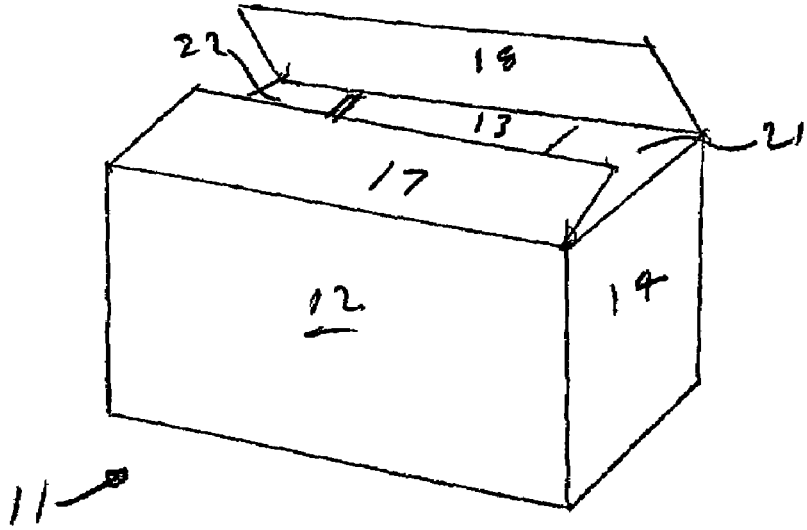
FIGURE 2 (PRIOR ART)
FIG. 2 is an isometric view of a container formed from the blank of FIG. 1.
Figure 3:
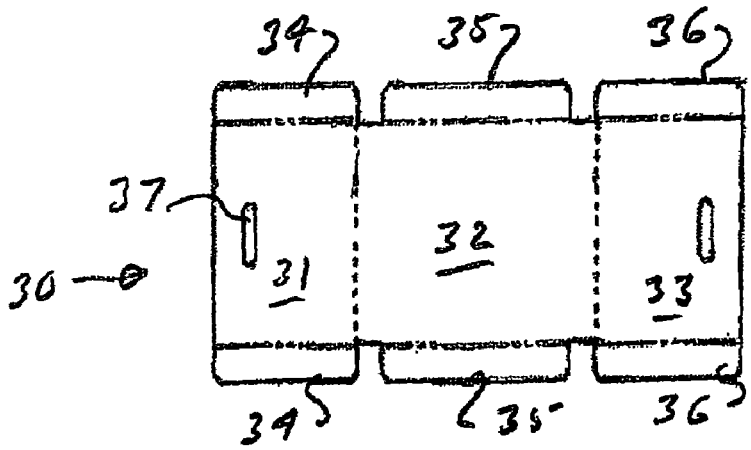
FIGURE 3 (PRIOR ART)
FIGS. 3-4 are top plan views of blanks for a prior art bliss box.
Figure 7:
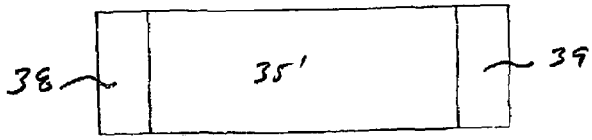
FIGURE 7 (PRIOR ART)
FIG. 7 is a top plan view of another end panel for a bliss box
Figure 8:
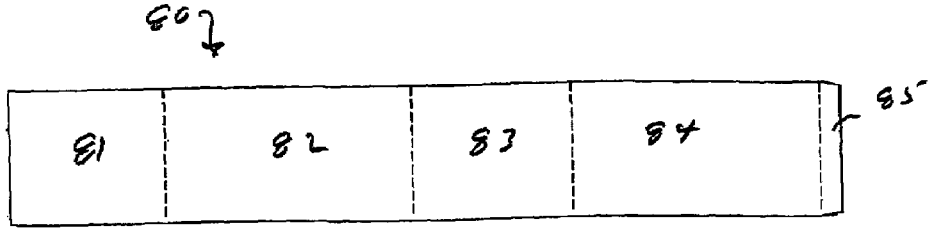
FIGURE 8 (PRIOR ART)
FIGS. 8-9 are top plan views of blanks for the prior art double cover container.
Figure 9:
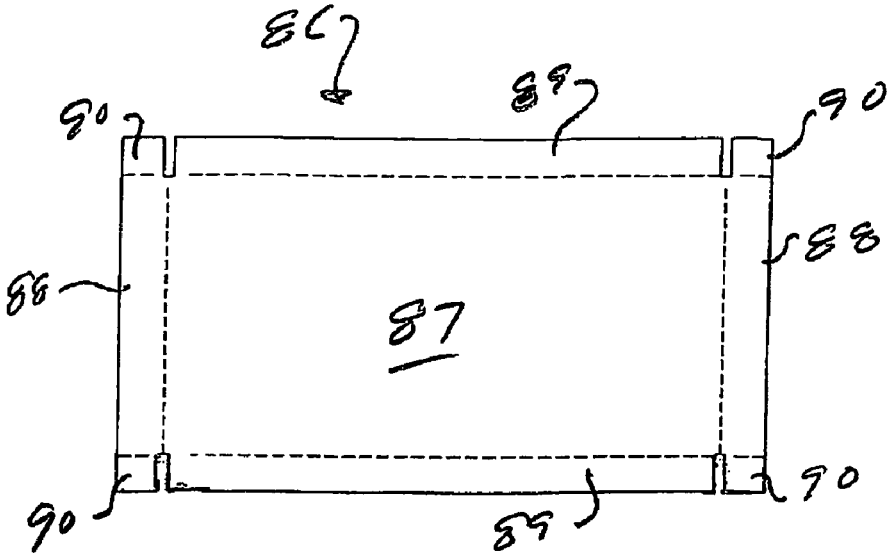
FIGURE 9 (PRIOR ART)

The bliss box was made from the blanks shown in FIGS. 3 and 7 and the half slotted container cover was made from the blank shown in FIG. 6. The bliss box was made 36 pound C flute corrugated with 35 pound liner glued to both sides of the flute. The end panels were made of 36 pound C flute corrugated with 35 pound liner glued to the outer side of the flutes and 42 pound liner glued to the inner side of the flutes. The telescoping cover was made from 33 pound C flute corrugated with 35 pound liner glued to both sides. The cover was telescoped over the box in these tests. The box weighed 1.7 pounds. When tested, it had a peak load of 1700 pounds and a side wall deflection of 0.33 inches.

One embodiment of the present invention that was tested against the bliss box/half slotted container lid had side walls made from 40 pound C flute corrugated with a 74 pound liner glued to the outer side of the flutes and a 69 pound liner glued to the inner side of the flutes. The lids were made from 26 pound C flute corrugated with 33 pound liner glued to both sides of the corrugated. The container weighed 1.33 pounds. When tested, it had a peak load of 2500 pounds and a side wall deflection of 0.13 inches.

Another embodiment of the present invention that was tested against the bliss box/half slotted container lid had double wall side walls with a 35 pound liner, a 26 pound B flute corrugated, a 35 pound liner, a 26 pound C flute corrugated and a 35 pound liner glued together in that order. The first 35 pound liner is the outer liner and the last 35 pound liner is the inner liner in the container. The lids were made from 26 pound C flute corrugated with 33 pound liner glued to both sides of the corrugated. The container weighed 1.30 pounds. When tested, it had a peak load of 2500 pounds and a side wall deflection of 0.13 inches.

In another series of tests, the same two embodiments of the present invention were compared to another bliss box/half slotted container lid design. The containers were 20 inches long, 13 inches wide and 11 inches deep.

Figure 4:
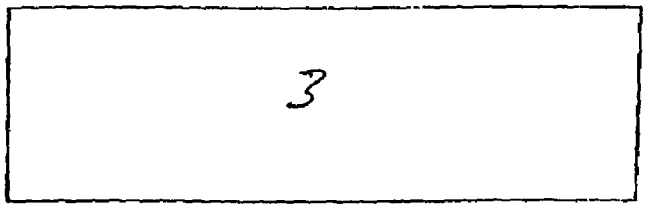
FIGURE 4 (PRIOR ART)
Figure 5:
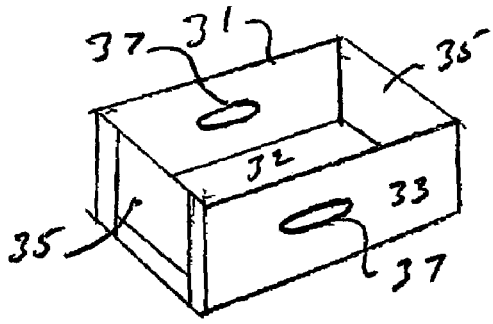
FIGURE 5 (PRIOR ART)
FIG. 5 is an isometric view of a bliss box formed from the blanks of FIGS. 3-4.

One bliss box was formed from the blanks of FIGS. 3, 4 and 6. The box had a body and end walls formed from a 33 pound C flute corrugated with a 45 pound liner glued to both sides. The half slotted container lid was formed of 26 pound C flute corrugated with 42 pound liner glued to both sides. It had a weight of 2.13 pounds. It had a peak load of 1900 pounds and a side deflection of 0.31 inches. The peak load is the maximum load that the box will attain before collapse.

One embodiment of the present invention that was tested against the bliss box/half slotted container lid had side walls made from 40 pound C flute corrugated with a 74 pound liner glued to the outer side of the flutes and a 69 pound liner glued to the inner side of the flutes. The lids were made from 26 pound C flute corrugated with 33 pound liner glued to both sides of the corrugated. The container had no hand holes. The box weighed 1.62 pounds. When tested, it had a peak load of 2300 pounds and a side wall deflection of 0.13 inches.

The same embodiment was made with hand holes in the side walls. It also weighted 1.62 pounds. When tested, it had a peak load of 2100 pounds and a side wall deflection of 0.125 inches.

Another embodiment of the present invention that was tested against the bliss box/half slotted container lid had side walls that were double wall and had a 35 pound liner, a 26 pound B flute corrugated, a 35 pound liner, a 26 pound C flute corrugated and a 35 pound liner glued together in that order. The first 35 pound liner is the outer liner and the last 35 pound liner is the inner liner in the container. The lids were made from 26 pound C flute corrugated with 33 pound liner glued to both sides of the corrugated. It container had no hand holes. The container weighed 1.58 pounds. When tested, it had a peak load of 2500 pounds and a side wall deflection of 0.13 inches.

The same embodiment was made with hand holes in the side walls. It also weighted 1.58 pounds. When tested, it had a peak load of 2200 pounds and a side wall deflection of 0.125 inches.

Although less board was used in the embodiments of the invention, these embodiments had greater peak load and less deflection that the bliss boxes with half slotted container lids.

In another test a container having a bottom and top corrugated lids with a crushed annular area in each lid was tested against a container having a bottom and top corrugated lids without a crushed annular area in either lid. Except for the crushed annular areas the bottom lids were otherwise the same and the top lids were otherwise the same. The bottom lid side panels were glued to the container side walls. The containers and lids were made with 26 pound C flute corrugated with 42 pound liner attached to outside of the flutes and 35 pound liner attached to the inside of the flutes. The containers were 20 inches long, 14 inches wide and 12 inches deep. The maximum compression load for the container with the lids with the crushed annular area was 1025 pounds. The maximum compression load for the container the lids without the crushed annular area was 825 pounds. The wall deformation at maximum load for the container with the lids with the crushed annular area was 0.070 inches. The wall deformation at maximum load for the container with the lids without the crushed annular area was 0.13 inches.

While embodiments of the invention has been illustrated and described, it will be appreciated that various changes can be made therein without departing from the spirit and scope of the invention.

The invention claimed is:

1. A container comprising a container having upstanding side walls of substantially equal height, top and bottom lids for the container, each of the lids having a central panel and side panels attached to the central panel by score lines, each of the lids being formed of a fluted corrugated material to which outer liners are glued, each of the lids having an annular crushed area in the central panel, the crushed section being conterminous with the score lines, the annular area being crushed so that the liners and the corrugated material are crushed together, the container side walls fitting into the annular crushed area of each lid, the bottom lid side panels being fastened to the container side walls.

2. The container of claim 1 wherein the bottom lid side panels are glued to the container side walls.

3. The container of claim 1 wherein there are no tabs on the side edges of the bottom lid side panels.

4. The container of claim 1 wherein the lids are single wall corrugated with one corrugated layer and a liner attached to each side of the corrugated layer.

5. The container of claim 1 wherein the side walls are single wall corrugated with one corrugated layer and a liner attached to each side of the corrugated layer.

6. The container of claim 1 wherein the side walls are multi-wall corrugated with at least two corrugated layers and a liner attached to the outer side of each corrugated layer, and a liner between the corrugated layers.

* * * * *